United States Patent [19]

Cassidy, Sr.

[11] 3,933,013

[45] Jan. 20, 1976

[54] CONTROL PANTY HOSE

[75] Inventor: Edward L. Cassidy, Sr., Burlington, N.C.

[73] Assignee: Alamance Industries, Inc., Burlington, N.C.

[22] Filed: Feb. 18, 1975

[21] Appl. No.: 550,221

[52] U.S. Cl. ..... 66/177; 66/198; 66/201; 66/202

[51] Int. Cl.[2] .... D04B 1/24; D04B 9/18; D04B 9/38

[58] Field of Search..... 66/175, 176, 177, 172 E, 66/201, 202, 178 A, 180, 198

[56] References Cited

UNITED STATES PATENTS

| | | | |
|---|---|---|---|
| 2,347,005 | 4/1944 | Smith, Jr. | 66/201 |
| 2,946,210 | 7/1960 | Morancy | 66/202 X |
| 2,946,211 | 7/1960 | Morancy | 66/202 X |
| 3,035,427 | 5/1962 | Chiodine | 66/202 X |
| 3,154,933 | 11/1964 | Holder | 66/172 E |
| 3,651,670 | 3/1972 | Burleson et al. | 66/177 |
| 3,720,078 | 3/1973 | Burleson | 66/177 X |

FOREIGN PATENTS OR APPLICATIONS

| | | | |
|---|---|---|---|
| 2,038,212 | 3/1971 | Germany | 66/177 |
| 634,830 | 3/1950 | United Kingdom | 66/172 E |

OTHER PUBLICATIONS

*Knitted Outerwear Times*, Jan. 26, 1970, Vol. 39, No. 4, pp. 30–32.

*Primary Examiner*—Wm. Carter Reynolds
*Attorney, Agent, or Firm*—Parrott, Bell, Seltzer, Park & Gibson

[57] ABSTRACT

The panty portion of the panty hose is knit of stretch and spandex yarns to provide compressive force against the body of the wearer. The panty portion includes an attractive pattern of relatively opaque areas and open lace areas with alternate courses being knit of spandex yarn and intervening courses being knit of main and auxiliary stretch yarns. The spandex yarn is knit in every wale of the opaque areas and is selectively knit and tucked in the open lace areas. The main stretch yarn is knit in every wale of both the opaque and open lace areas while the auxiliary stretch yarn is knit in plated relationship with the main stretch yarn in the opaque areas and is floated in the open lace areas.

7 Claims, 4 Drawing Figures

CONTROL PANTY HOSE

This invention relates generally to a control top panty hose and more particularly to such a garment in which panty portion includes an open lace pattern and provides sufficient compressive force to control and shape the figure of the wearer.

It is known to attach stocking legs to a panty type girdle to provide a panty hose in which the panty portion provides some control of the figure of the wearer. It is also known to incorporate a heavy spandex or elastic yarn in the panty portion of panty hose to provide some control of the figure of the wearer. However, the use of a panty girdle requires a separate sewing operation to attach the stocking legs thereto. This separate sewing operation increases the cost of the garment and forms seams around the legs which are objectionable to some wearers. In those cases where heavy elastic or spandex has been incorporated in the panty portion of panty hose, the panty portion has a heavy and dense appearance and restricts the amount of air which can pass therethrough to contact the body of the wearer.

With the foregoing in mind, it is an object of the present invention to provide a control top panty hose wherein the panty portion is knit with spandex yarn and textured stretch yarn to form an attractive pattern of relatively opaque areas and open lace areas. The panty portion provides sufficient compressive force to control and shape the figure of the wearer and the open lace areas permit the passage of air therethrough. The panty portion may be economically knit on the same circular hosiery knitting machine on which the sheer legs of the panty hose are knit.

In accordance with the present invention, the panty portion is knit with alternate courses of spandex yarn and intervening courses of main and auxiliary stretch yarns. The spandex yarn is knit in every wale of the opaque areas and is selectively knit and tucked in the open lace areas. The main stretch yarn is knit in every wale of both the opaque and open lace areas and the auxiliary stretch yarn is knit in plated relationship with the main stretch yarn in the opaque areas and is selectively knit and floated in the open lace areas. The auxiliary stretch yarn is floated in the wales of the open lace areas in which the spandex yarn is tucked. The spandex yarn is preferably tucked in pairs of adjacent wales in the open lace areas and the auxiliary yarn is floated across the pairs of adjacent wales in the open lace areas in which the spandex yarn is tucked. The main and auxiliary stretch yarns are preferably of substantially the same total denier as the spandex yarn so that the size of yarn knit in adjacent courses is substantially the same throughout the panty portion of the garment.

Figure 1:
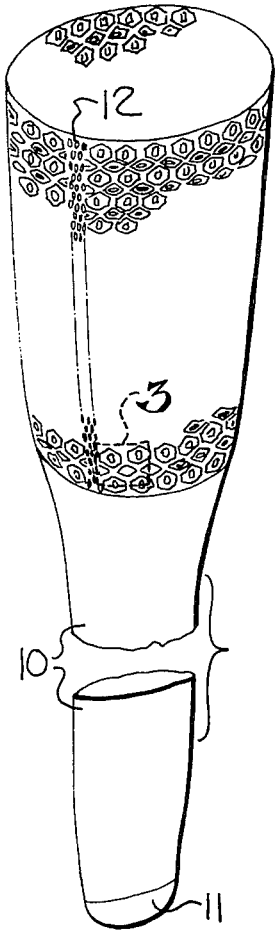
Figure 2:
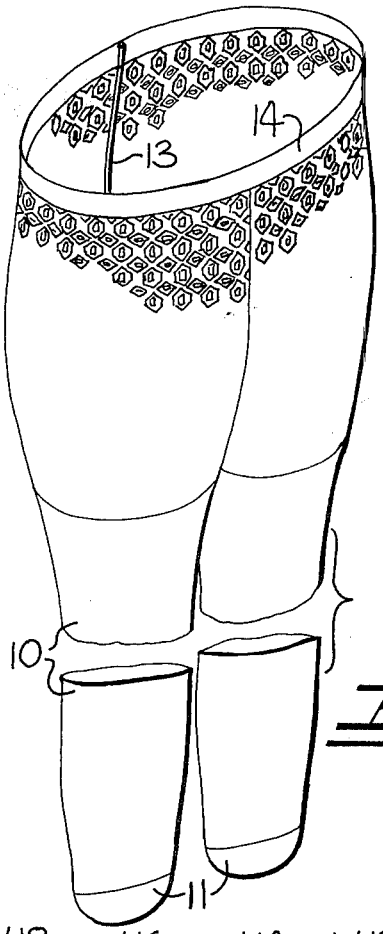
Figure 3:
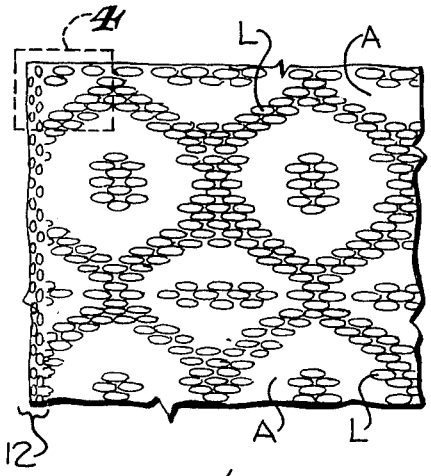
Figure 4:
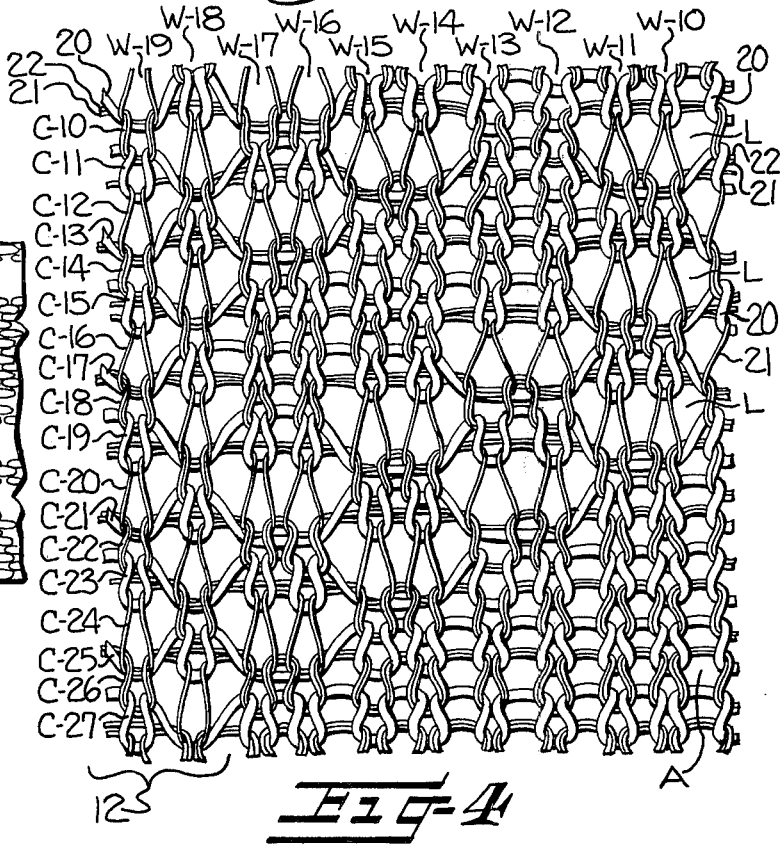

Other objects and advantages will appear as the description proceeds when taken in connection with the accompanying drawings in which FIG. 1 is an isometric view of a hosiery blank used in forming the panty hose;

FIG. 2 is an isometric view of the completed panty hose which is formed of a pair of blanks of the type shown in FIG. 1;

FIG. 3 is an enlarged, somewhat schematic view of that area of the fabric enclosed within the dash-dot rectangular 3 in FIG. 1 and illustrating one type of pattern of relatively opaque and open lace areas which may be formed in the panty portion in accordance with the present invention; and FIG. 4 is a greatly enlarged fragmentary view of that portion of the fabric enclosed within the dash-dot rectangular 4 in FIG. 3 and illustrating the manner in which the yarns are selectively knit, plated and tucked to form the opaque and open lace areas.

The panty hose illustrated in the present application is of the type which is formed by initially knitting a pair of seamless tubular blanks, slitting the upper ends of the tubular blanks in a walewise direction and then sewing together the slit edges of the pair of hosiery blanks to form a panty portion with the legs depending therefrom. A crotch patch or panel may be inserted between the hosiery blanks, if desired, However, it is to be understood that the present control top is not limited to use with this particular type of panty hose but may be incorporated in panty hose which are formed by other known methods. Also, the present control top is not limited to use in panty hose but may be utilized in other types of lower body garments, such as girdles, bathing suit trunks, tights and the like.

The panty hose blank shown in FIG. 1 includes a leg portion 10, usually knit of a relatively fine denier yarn, and a closed lower toe portion 11. The upper portion of the hosiery blank is adapted to form the panty portion of the garment and is provided with an attractive pattern of relatively opaque areas and open lace areas. A relatively narrow walewise extending strip or panel of distinctive stitches 12 extends downwardly from the upper end of the hosiery blank and is provided to form a guide for forming the slit in the panty portion, for purposes to be presently described.

To form the panty hose shown in FIG. 2, from a pair of hosiery blanks of the type shown in FIG. 1, walewise or vertically extending slits are formed down the center of the panel 12 of the hosiery blanks. The corresponding edges of the slits of the pair of blanks are then sewn together, as by a row of overedge stitching 13 and with or without a crotch patch or panel between the hosiery blanks, to join together the two hosiery blanks and form a seam extending from the front of the waist opening downwardly, through the crotch and upwardly to the rear of the panty portion. An elastic band 14 may be suitably attached to the upper portion of the panty and the lower toe ends may be closed in any suitable manner to complete the panty hose.

The particular pattern of relatively opaque areas and open lace areas shown in the drawings will be described, however, it is to be understood that patterns other than that illustrated in the drawings may be formed in the control top, if desired. As best shown in FIG. 4, the panty portion (wales W-10 through W-17) is knit with alternate courses (odd numbered courses) of spandex yarn 20 and intervening courses (even numbered courses) knit of a main stretch yarn 21, and an auxiliary stretch yarn 22. The spandex yarn 20 is knit in every wale of the opaque areas, indicated at A in FIG. 4, and is selectively knit and tucked in the open lace areas, indicated at L. The main stretch yarn 21 is knit in every wale of both the opaque and open lace areas and the auxiliary stretch yarn 22 is knit in plated relationship with the main stretch yarn 21 in the opaque areas A and is selectively knit and floated in the open lace areas L.

As illustrated in FIG. 4, the spandex yarn 20 is tucked across pairs of adjacent wales in the open lace areas L and the auxiliary stretch yarn 22 is floated across the pairs of adjacent wales in the open lace areas in which the spandex yarn is tucked. The main stretch yarn 21 forms elongated or held stitch loops in the pairs of adjacent wales in which the spandex yarn 20 is tucked and the auxiliary stretch yarn is floated to provide the open lace appearance to the fabric.

The adjacent courses of the fabric in the control top panty portion are preferably of substantially the same size and the size of the main stretch yarn is preferably less than half the size of the auxiliary stretch yarn.

The held elongated stitch loops of the main stretch yarn are very thin or sheer and aid in the formation of the open lace appearance in the panty portion. It is preferred that the spandex yarn be approximately 70 denier with a double covering of nylon yarn. It is also preferred that the auxiliary stretch yarn be approximately 50/17 denier and that the main stretch yarn be approximately 20/7 denier. Thus, the alternate or odd numbered courses, knit of the spandex yarn 20, are approximately 70 denier while the intervening or even numbered courses, knit of the main stretch yarn 21 and the auxiliary stretch yarn 22, are also approximately 70 denier.

To form the slit guide panel 12 (wales W-18 and W-19 of FIG. 4) the spandex yarn 20 is tucked beneath a single wale and in a staggered manner while the auxiliary stretch yarn 20 is floated across the single wale in which the spandex yarn is tucked. As illustrated in FIG. 4, the spandex yarn 20 is tucked in pairs of adjacent wales in the open lace areas L and the pattern is formed by stepping the tucked spandex yarn as successive courses are knit in the panty portion. By varying the frequency and staggered arrangement of tucks, the pattern of the open lace and opaque areas may be varied to form any number of different patterns.

METHOD OF KNITTING

The knitting of the panty hose will be described as being knit on a multifeed circular hosiery knitting machine having four yarn feeding and stations station spaced around the needle cylinder. However, it is to be understood that the panty hose may be knit on a knitting machine having a lesser or greater number of knitting stations and having sufficient patterning mechanism for selectively knitting, floating and tucking yarns.

Generally, the method includes the feeding of the spandex yarn 20 at the first and third knitting stations while knitting the spandex yarn in every wale of the opaque areas A and selectively knitting and tucking the spandex yarn in selected wales in the open lace areas L. The main and auxiliary stretch yarns are fed at the second and fourth knitting stations while the main yarn 21 is knit in every wale of both the opaque and open lace areas and while the auxiliary yarn 22 is knit in plated relationship with the main yarn in the opaque areas and is floated across those wales in which the tucks were formed of the spandex yarn in the open lace areas.

More specifically, it will be assumed that course C-10 of FIG. 4 is knit at the second knitting station and it will be noted that the auxiliary yarn 22 is floated across wales W-10, W-11 and W-14, W-15. The main stretch yarn 21 forms knit stitch loops in these wales. Both the auxiliary stretch yarn 22 and the main stretch yarn 21 form knit stitch loops in plated relationship in wales W-12, W-13 and W-16, W-17.

Course C-11 is knit at the third knitting station and tucks are formed of the spandex yarn 20 across wales W-10, W-11 and W-14, W-15 while the stitch loops of the main yarn 21 are held to form elongated stitches in these wales. The spandex yarn 20 forms plain stitch loops in the wales W-12, W-13 and W-16, W-17. Course C-12 is knit at the fourth feeding station and both the auxiliary and main stretch yarns 22, 21 are knit in plated relationship in the wales W-10 through W-15. The auxiliary stretch yarn 22 is floated across the wales W-16, W-17 and the main stretch yarn 21 forms stitch loops in these wales. The course C-13 is knit at the first knitting station and the spandex yarn 20 is knit to form plain stitch loops in wales W-10 through W-15 while the spandex yarn 20 is tucked in wales W-16 and W-17.

Course C-14 is knit at the second feeding station and the sequence is repeated with different pairs of needles being tucked with the spandex yarn to form the diagonal rows of open stitches and to provide any desired type of pattern of opaque and open lace areas. As shown in FIG. 4, the spandex yarn 20 is tucked in a stepped manner to form diagonal rows of open stitches. The slit guide panel 12 is preferably about 18 wales wide and portions of two wales of the panel 12 are illustrated in wales W-18 and W-19 of FIG. 4. During the knitting of course C-10, the main stretch yarn 21 is knit in wales W-18 and W-19 while the auxiliary stretch yarn 22 is floated across wale W-18 and knit in plated relationship with the main stretch yarn 21 in wale W-19. In course C-11, the spandex yarn 20 is tucked in wale W-18 and is knit in wale W-19. In course C-12, the main stretch yarn 21 is knit in both wales W-18 and W-19 while the auxiliary stretch yarn 22 is floated across wale W-19 and is knit in plated relationship with the main stretch yarn 21 in wale W-18. In course C-13, the spandex yarn 20 is knit in wale W-18 and tucked in wale W-19. This sequence is repeated throughout the knitting of the panel 12 with the spandex yarn 20 being alternately knit and tucked in single wales which are staggered from course to course.

The knitting of the control top continues, knitting the pattern of opaque and open lace areas, to form the desired length in the panty hose blank to form the panty portion of the panty hose. The leg 10 is then knit by changing the yarns and knitting fine denier yarn in any desired pattern to form the desired length of leg 10. Additional yarn may be added to reinforce the area which is to form the toe portion 11, if desired. Pairs of the hosiery blanks are then slit along the slit guide panels 12 and joined together to form a panty hose of the type shown in FIG. 2, in the manner heretofore described.

The fabric, as illustrated in FIG. 4, has stretch in two directions and the open lace areas L are formed by utilizing the relatively lightweight main stretch yarn 21 (20/17 denier) in the held or elongated stitch loops. The heavier auxiliary stretch yarn 22 (50/17 denier) is floated while the spandex yarn 20 (covered 70 denier) is tucked across pairs of adjacent needle wales. The main and auxiliary stretch yarns may be nylon and may be textured by any well-known process, such as by false-twisting, to impart stretch characteristics thereto. The open lace characteristic of the fabric permits the fabric to "breathe" and provides an attractive pattern. The control top has sufficient compression to control and shape the figure of the wearer.

In the drawings and specification there has been set forth a preferred embodiment of the invention, and although specific terms are employed, they are used in a generic and descriptive sense only and not for purposes of limitation.

That which is claimed is:

1. A lower body garment, such as panty hose, including a control panty portion knit of stretch and spandex yarns to provide compressive force against the body of the wearer and comprising an attractive pattern of relatively opaque areas and open lace areas, said panty portion being knit with alternate courses of spandex yarn and intervening courses knit of main and auxiliary stretch yarns, said spandex yarn being knit in every wale of said opaque areas and being selectively knit and tucked in said open lace areas, said main stretch yarn being knit in every wale of both said opaque and open lace areas, and said auxiliary stretch yarn being knit in plated relationship with said main stretch yarn in said opaque areas and being selectively knit and floated in said open lace areas, said auxiliary stretch yarn being floated in the wales of said open lace areas in which said spandex yarn is tucked.

2. A garment according to claim 1 wherein said spandex yarn is tucked in pairs of adjacent wales in said open lace areas.

3. A garment according to claim 2 wherein said spandex yarn is knit in pairs of adjacent wales between the tucks in said open lace areas.

4. A garment according to claim 2 wherein said auxiliary yarn is floated across said pair of adjacent wales in said open lace areas in which said spandex yarn is tucked.

5. A garment according to claim 1 wherein said main stretch yarn is less than half as large as said auxiliary stretch yarn, and wherein the total size of said main and auxiliary stretch yarns is substantially the same as the size of said spandex yarn.

6. A garment according to claim 5 wherein said spandex is covered and is approximately 70 denier, said main stretch yarn is approximately 20/7 denier, and wherein said auxiliary stretch yarn is approximately 50/17 denier.

7. A garment according to claim 4 including a walewise extending slit guide panel in which said spandex yarn is alternately knit and tucked in single wales, said main stretch yarn is knit in every wale, and said auxiliary stretch yarn is atlernately knit and floated with the floats being formed in the wales in which said spandex yarn is tucked.

* * * * *